US006085679A

United States Patent [19]

Tiesler

[11] Patent Number: 6,085,679

[45] Date of Patent: Jul. 11, 2000

[54] SAIL BOAT JIBE CONTROL SYSTEM

[76] Inventor: Robin F. Tiesler, Box 217, 6175 Carversville Rd., Carversville, Pa. 18913-0217

[21] Appl. No.: 09/241,900

[22] Filed: Feb. 2, 1999

[51] Int. Cl.[7] ..... B63B 15/00

[52] U.S. Cl. ..... 114/98; 114/99; 114/102.18

[58] Field of Search ..... 114/89, 97, 98, 114/99, 102.1, 102.16, 102.18, 102.19, 102.2, 102.21

[56] References Cited

U.S. PATENT DOCUMENTS

| | | | |
|---|---|---|---|
| 2,223,389 | 12/1940 | Schaedler | 24/132 |
| 3,391,907 | 7/1968 | Vogelsang | 254/150 |
| 3,396,689 | 8/1968 | Sommer | 114/98 |
| 3,802,366 | 4/1974 | Mankawich | 114/102.21 |
| 4,138,962 | 2/1979 | Waelder | 114/102 |
| 4,630,564 | 12/1986 | Duckman et al. | 114/98 |
| 4,762,318 | 8/1988 | Phillips et al. | 272/137 |
| 4,830,340 | 5/1989 | Knitig | 254/391 |
| 4,912,814 | 4/1990 | McKenzie | 24/115 H |
| 5,070,802 | 12/1991 | Corlett | 114/99 |
| 5,335,616 | 8/1994 | Tiesler | 114/172 |
| 5,390,617 | 2/1995 | Van Breems | 114/98 |

FOREIGN PATENT DOCUMENTS 0 630 806 12/1994 European Pat. Off. .

08192793 7/1996 Japan .

OTHER PUBLICATIONS

2–Page Advertisement entitled "Why You Should Have a Heinson Boom Control System"(undated).

Pages 14 and 15 of *Practical Sailor* magazine entitled "Controlling Jibes With Boom Brakes" dated Jan. 1, 1994.

Internet pages on Product Information regarding Boom Brake and Installation Kits (3 pages) copyright 1997, Boyle Communications, Inc.

*Primary Examiner*—Stephen Avila
*Attorney, Agent, or Firm*—Synnestvedt & Lechner LLP

[57] ABSTRACT

A sail boat boom control system provides braking forces for restraining movement of the boom during down wind sailing or sailing with a quartering breeze. The system comprises a boom restrainer loop attached to the boom and resiliently tensioned, pivotally mounted friction device which is adjustable to apply friction forces restraining movement of the boom loop, thereby providing the braking force on the boom. The friction device is adjustably controlled by a control line extending to a position where it is easily operated by the helmsman or other crew. A quick-release device releases the control line when required to allow the friction device to move to a position in which the boom is free from restraint. Deck-mounted and mast-mounted friction control devices are disclosed.

18 Claims, 3 Drawing Sheets

FIG. 3
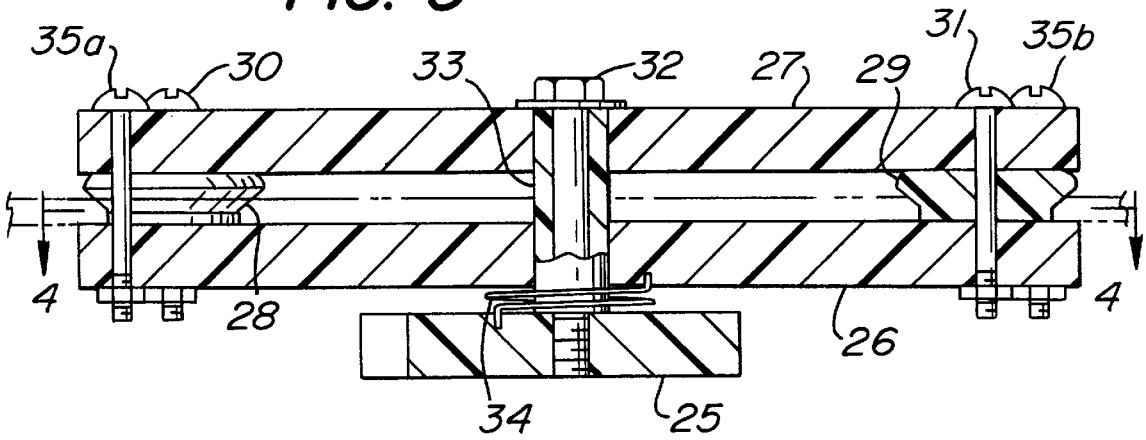
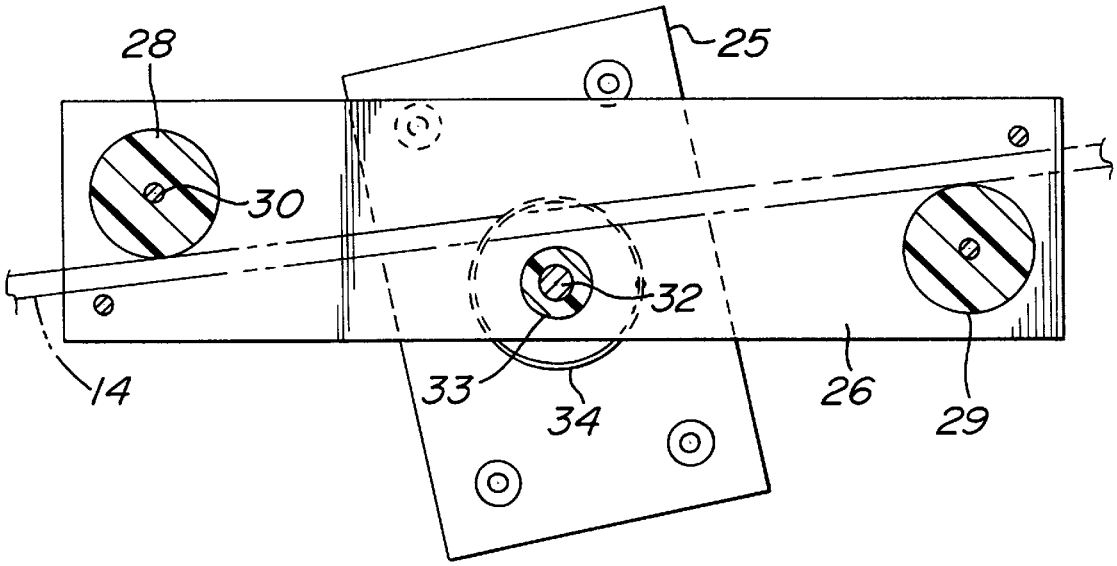
FIG. 4

SAIL BOAT JIBE CONTROL SYSTEM

FIELD OF THE INVENTION

This invention relates to a boom control system for a sail boat and, more particularly, for a system for controlling the position of the boom of the boat, particularly when the boat is being sailed down wind or with a quartering breeze.

BACKGROUND OF THE INVENTION

A number of devices have been available for locking or stabilizing the position of a boom of a sail boat when sailing with a following or quartering breeze. The importance of some control will be recognized by those skilled in the art who have experienced the effects of an accidental jibe due to a shift in wind direction or when the helmsman accidently changes course so that the wind is on the opposite side of the main sail and the boom suddenly swings across the deck. Such accidental jibes are hazardous to the crew, can cause serious damage to the rigging and may even cause a knock-down of the vessel. Even controlled jibes can be hazardous if not done with care.

Short of lashing the boom or through use of a preventer or similar boom locking device, a number of sail boat boom brakes utilizing the frictional resistance applied by a friction device to a line which restrains movement of a boom have become available and are a part of the prior art. One of these systems known as the Heinson boom control system produced by the Heinson Co., Moraga, Calif. works on the principle disclosed in U.S. Pat. No. 4,138,962. In this type of system, a friction device in the form of a single friction drum is carried by a hanger attached to the boom of the boat. A line attached to one or more cleats accessible from the cockpit extends forwardly to a swivel block mounted on the deck. The line extends from the swivel block to the drum, is wrapped around the drum several times and then extends downwardly to a second cleat or another swivel block on the opposite side of the boat from which it is extended aft to a second cleat accessible from the cockpit. When the line is cleated, frictional resistance with the drum locks the boom in place. Tension may be released from the cockpit entirely or may be gradually released as a jibe occurs, thereby easing the boom to the desired position.

More recently issued U.S. Pat. No. 5,390,617 illustrates another type of boom brake mounted on a hanger attached to the boom. In this patent, the hanger carries three spools or sheaves. A line secured adjacent one side of the deck extends to the boom and in a serpentine path is in contact with the friction surfaces of the three spools. Two of the spools are fixed against rotation and the third, offset between the first two, is rotatable and is provided with a manually adjustable brake so that a variable frictional resistance to motion can be applied. In a further embodiment of the patent, where adjustable braking is not required, the three spools are all non-rotatable.

Many sailors object to devices of the kind described due to the fact that they are relatively difficult to control by the helmsman while he is in the act of steering the boat and also because the relatively heavy braking device is located where it can strike the head of a crew member, creating the kind of hazard that such devices are intended to eliminate.

SUMMARY AND OBJECTS OF THE INVENTION

In summary, the invention comprises a sail boat boom control system which consists of a single loop line extending across the boat and through two or more swivel blocks to locations on the boom spaced away from the mast. A section of the line passes through a pivotally-mounted friction device for application of friction resistance to the loop, thereby restraining movement of the boom. The friction device can be set from the cockpit by the helmsman to provide the degree of frictional resistance deemed necessary to control the swinging motion of the boom.

In accordance with the invention, first resiliently operable means act on the loop to take up slack and provide a degree of resilience to the restraint of the boom. An adjustable tension control device is operable to regulate the friction device to apply the desired tension on the loop, thereby causing the necessary frictional resistance to movement of the line, thereby providing the braking force. The device allows for return to a release position in which no frictional resistance is imparted to the loop, and the boom is free to swing without restraint.

Objects of the invention include the provision of a sail boat jibe control system which is easy to set up and use with minimal interference with the use of cockpit space.

Another object of the invention is the provision of a jibe control system which is easily and quickly adjustable so as to accommodate changes in said conditions.

A further objective of the invention is the provision of features allowing for instantaneous release of restraining forces on the boom.

Other objects and advantages will become apparent from the following description and drawings illustrating presently preferred embodiments of the invention.

BRIEF DESCRIPTION OF THE DRAWINGS

FIG. 3 is a sectional view of the control device used in the embodiments of FIGS. 1 and 2, the device being an enlarged scale with respect to FIGS. 1 and 2; and FIG. 4 is a plan sectional view taken along lines 4—4 of FIG. 3.

DETAILED DESCRIPTION OF THE PREFERRED EMBODIMENT

Figure 1:
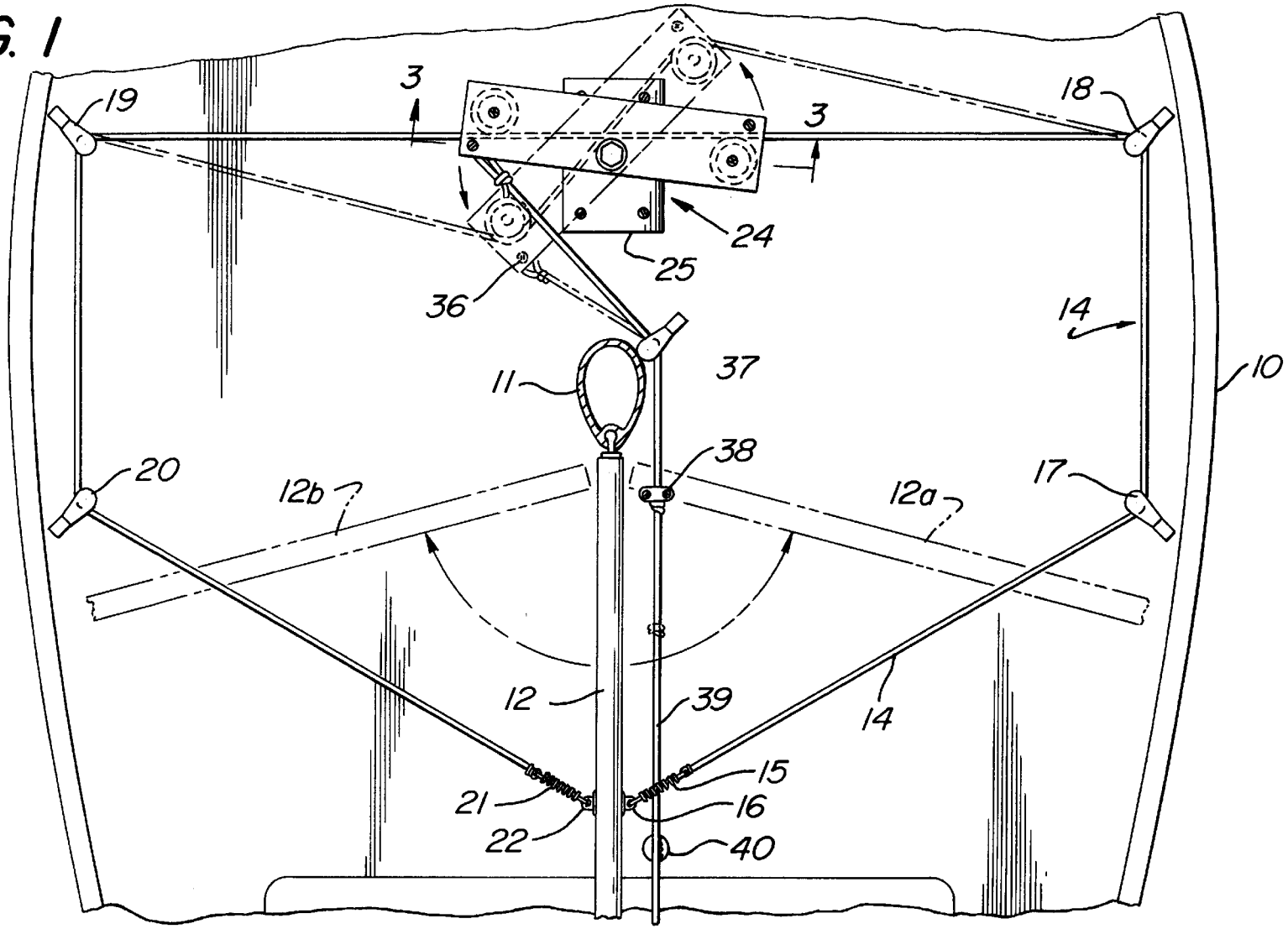
FIG. 1 illustrates a first preferred form of the invention in which a deck-mounted boom control system is provided.

With reference first to FIGS. 1, 3 and 4, a sail boat 10 has a mast 11 to which a boom 12 is pivotally mounted for movement between positions substantially as shown by broken lines 12*a* and 12*b*. As is known in the art, a main sail (not illustrated) is attached to the mast and the boom.

According to the embodiment of the invention illustrated in FIG. 1, a boom restrainer line 14 is resiliently tensioned and affixed to the boom 12 by means such as first spring 15 having a hook at one end which is attachable to eye 16 or other suitable attachment device, such as a bail projecting downwardly beneath the boom. A first section of line 14 extends from spring 15 to a swivel block 17 of conventional construction which, in FIG. 1, is located along the starboard rail of the boat. Restrainer line 14 then extends forwardly along the deck through a second swivel block 18, crosses the deck to a swivel block 19 adjacent the port rail, then aft to a fourth swivel block 20 and then diagonally upwardly from block 20 to the boom where it is resiliently attached by a spring 21 having a hook-shaped end which is hooked through a second eye 22 secured to the boom 12 adjacent to eye 16. The points of attachment to the boom should be equidistantly spaced from mast 11 and may be a single bail hanging from the boom. As shown, the springs yieldably tension line 14 for reasons to be explained hereinafter. The restrainer line 14 provides a loop which moves with the boom and serves as a means for restraining boom movement.

In the embodiment of FIG. 1, the side-to-side motion of the boom 12 is controlled by a control device 24 which provides friction resistance to movement of boom restrainer line 14. Control device 24 is pivotally mounted on the deck of the sail boat 10 in a position located forwardly of the mast, although other mounting positions may be used and are considered to be within the scope of the invention.

With reference to FIGS. 3 and 4, control device 24 preferably includes a base 25 bolted or otherwise firmly secured to the deck of the boat and a pair of elongated members 26 and 27 between which a pair of sheaves 28 and 29 having oppositely facing friction surfaces 28*a* and 29*a* respectively are positioned for interengagement with the surface of the boom restrainer line. Sheaves 28 and 29 are non-rotatably secured between members 26 and 27 by any suitable means such as bolts 30 and 31. A bolt 32 extending through sleeve 33 and threaded into base plate 25 comprises a pivotal mounting means for pivotally mounting members 26 and 27 for rotary movement with respect to the base 25. A coil spring 34 having one end connected to member 26 and the opposite end to base 25 fits over sleeve 33 and biases the members 26 and 27 to the full line position shown in FIG. 1. As best seen in FIGS. 1 and 4, the sheaves are laterally offset from the pivotal axis so that there is no interference between sleeve 33 and the boom restrainer axis. Additional bolts 35*a* and 35*b* are provided to secure the plates together and act as retainers for the control line.

For adjusting the position of control device 24, an adjusting means such as control line 39 is secured at one end of members 26 and 27 by means such as bolt or bail 36. Line 39 extends through a swivel block 37, an eye 38 and is fastened by means such of a jam cleat 40 which may be located near the cockpit for access by a crew member. Preferably, cleat 40 is fastened where it can be easily reached by the helmsman.

According to the invention, no resistance to shifting movement of boom 12 is offered when the control device 24 is as shown in the full line position of FIG. 1. In order to provide resistance to movement of the boom restrainer line 14, the control device is pivoted in a counterclockwise direction from the position in which it is illustrated in FIG. 1 in full lines. Rotation of the control device from the full line position to the broken line position increasingly tensions the boom restrainer line and increases frictional resistance to movement of the line which accordingly increases restraining forces on the boom. In the fully rotated position, which is typically substantially at 90° from the full line position illustrated, the boom may be substantially locked in any selected position. In intermediate positions of adjustment of the control device, such as that shown in broken lines in FIG. 1, sufficient resistance to movement of the restrainer line is provided, so that in the event of a jibe, the boom will move slowly and in controlled fashion from one side of the boat to the other. The degree of tension being selectively controlled by the helmsman or other member of the crew can be accomplished without the need to leave the cockpit.

Figure 2:
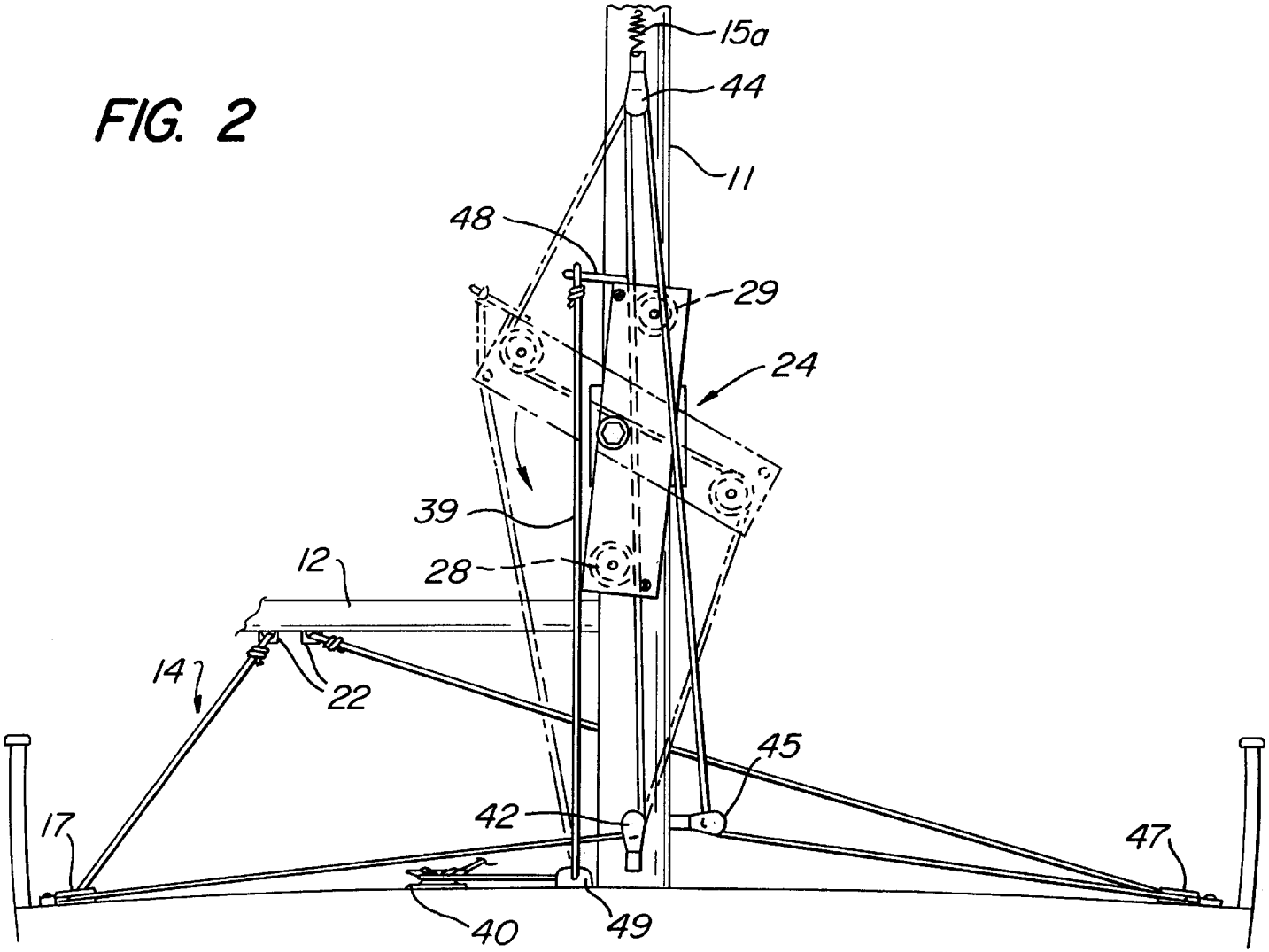
FIG. 2 is an elevational front view of a sail boat showing an embodiment of the invention wherein the control device is mounted on the forwardly facing surface of the mast of the sail boat.

Turning now to FIG. 2, an embodiment of the invention is illustrated in which the control device 24 is mounted on the forward surface of the mast 11. In the description of FIG. 2, like numbers will be used to identify like parts. As in FIG. 1, one end of boom restrainer line 14 is connected to boom 12. Although the line may be attached by means of a coil spring as in the embodiment of FIG. 1, the necessary tension is supplied in FIG. 2 by a block 44 which is resiliently attached to the boom by a spring 15*a*. The restrainer line extends from boom 12 to swivel block 17 adjacent the starboard side of the boat and then extends across the deck to a second swivel block 42 secured to the base of the mast 11. From the base of the mast, restrainer line 14 extends upwardly between sheaves 28 and 29, passing around upwardly biased swivel block 44 fixed on the mast 11 above control device 24. The restrainer line then extends vertically downwardly to a sheave 45 affixed to the mast and/or other suitable surface proximal to the swivel block 42. The restrainer line then extends laterally to a swivel block 47 located adjacent the port side of the boat and then extends diagonally rearwardly to a fastener such as eye 22. As indicated above, the restrainer line in FIG. 2 is resiliently tensioned by spring 15*a*.

As in the embodiment of FIG. 1, tension control means is preferably provided by control line 39 which is affixed to a bracket or bail 48 on an upper surface of control device 24. Control line 39 extends downwardly to a guide or block 49 mounted on the deck and from there to cleat 40 attached in or adjacent to the cockpit for accessability by the crew or the helmsman.

Similarly to the embodiment of FIG. 1, rotation of the control device 24 from the vertical position in which no resistance to movement of the line and the boom is provided to positions of increasing resistance as shown, for example, in the broken line position, is provided. Thus, either embodiment of the invention allows for the application of the required amount of frictional resistance to swinging motion of the boom from any selected boom position.

In the implementation of the invention, it should be understood that other mounting locations for control device 24 may be provided so long as the device is pivotally movable from a position in which no frictional resistance is offered to movement of the line to a position in which motion is prevented, except under the most adverse wind conditions. In addition, the portions of the restrainer line extending from the boom may pass through swivel blocks attached to the shrouds so as to keep them clear of the deck if desired. The resilient tensioning of boom restrainer line 14 provided by springs 15 and 21 of FIG. 1 or spring 15*a* in FIG. 2 may be provided at other positions along the line, as by spring-mounted blocks.

In use, the sheaves provide arcuate contact paths with the boom restrainer line which provide increased resistance to movement of the line as the control device is rotated. If needed, further increase in frictional resistance to line movement can be provided by increasing line diameter. Release of control line 39 can be accomplished quickly and immediately causes return of the control device to the position in which the boom is unrestrained.

What is claimed is:

1. A system for controlling swinging movements of the boom of a sail boat, said system comprising:

a boom restrainer line having end sections attached to and extending from the boom to opposite sides of the sail boat, each said line end section being attached to the boom in spaced relationship to the mast, the line sections being attached to the boom equidistantly from the mast, the line sections being interconnected whereby said boom restrainer forms a loop which moves in response to boom movements;

means resiliently tensioning the boom restrainer line;

a friction device having at least one friction member having a first friction surface engagable with said restrainer line for producing a friction force resisting restrainer line movement;

tension control means acting on said friction device for selectively increasing restrainer line tension, said increase in restrainer line tension increasing the friction force acting on the line, thereby selectively increasing resistance to movement of said line and said boom.

2. Apparatus according to claim 1, wherein said friction device includes a pivot axis mounting said friction device for pivotal movement, said friction device being pivotally movable about said pivot axis for moving said at least one friction member toward and away from said restrainer line and said tensioning means comprises an adjustable control for adjusting the position of said friction member, thereby regulating pressure applied by said friction member normally to the restrainer line and the frictional resistance to line movement.

3. Apparatus according to claim 2, further including a spring acting on said friction device for biasing said friction member into a position out of contact with said restrainer line.

4. Apparatus according to claim 1, further including a second friction member spaced from the first at a location on said movable support spaced from the pivot axis on the side opposite to the first named friction member, said restrainer line following a path extended between the friction members, pivotal movement of the friction device in a first direction moving said friction members out of contact with the restrainer line and in a second direction opposite to the first moving said friction members into engagement with the restrainer line.

5. Apparatus according to claim 4, wherein the friction surfaces of said friction members are arcuately configured.

6. Apparatus according to claim 4, wherein said friction device is pivotally mounted on the sail boat mast.

7. Apparatus according to claim 6, wherein the means for tensioning the restrainer line comprises a block, a biasing spring connecting the block to the mast, the restrainer line passing through the block and being tensioned by said biasing spring.

8. Apparatus according to claim 4, wherein the means for tensioning the restrainer line comprises a pair of biasing springs, each of said biasing springs applying a resilient tensioning force to said restrainer line.

9. Apparatus according to claim 8, wherein said springs each attach an end of said restrainer line to said boom.

10. Apparatus according to claim 9, wherein said friction device further includes means mounting said pivot axis on the sail boat deck.

11. A boom control system for controlling the position of a sail boat boom pivotally mounted for side-to-side movement about the long axis of a sail boat mast, the system comprising:

a boom restrainer line attached at each end to the sail boat boom and movable upon said side-to-side movement of the boom;

the attachment locations for the restrainer line being equidistantly spaced from the mast;

a friction device for application of friction to the restrainer line resisting movement of the restrainer line in response to tension produced by side-to-side movement of the boom about the long axis of the mast, said friction device comprising a pair of spaced apart, non-rotatable friction members having oppositely facing, arcuately-shaped friction surfaces, said friction surfaces being displaced from each other lengthwise of the path of said restrainer line for interengagement therewith;

resilient means for maintaining a predetermined tension in said restrainer line; and tension adjusting means for regulating the tension of said restrainer line, the line tension producing forces extending normally of said friction surfaces and thereby producing friction forces on the restrainer line for resisting boom forces tending to move the boom from one side of the boat to the other.

12. A control system according to claim 11, including means pivotally mounting said friction device for movement of said friction surfaces toward and away from said restrainer line;

biasing means for biasing said friction device to a position in which the friction surfaces are spaced from the restrainer line, said tension means pivoting said friction device against the action of the biasing means, said tension means being releasable to allow movement of the friction device by the biasing means to said position in which the friction surfaces are spaced from the restrainer line.

13. A control system according to claim 11, wherein said resilient means comprises a pair of springs each attaching opposite ends of said restrainer line to said boom.

14. A control system according to claim 11, wherein said resilient means comprises a block, a biasing spring for mounting said block on said boat, the restrainer line passing through the block and being tensioned by said biasing spring.

15. A boom control system for controlling jibing of a sail boat boom, said boom being mounted for pivotal movement on a boat mast projecting upwardly from the boat hull, and supporting with the mast, a sail, said control system comprising:

a boom restrainer line comprising first and second restrainer line sections;

means affixing each of the restrainer line sections to the boom at a position remote from the sail boat mast, said first restrainer line section being extended in a first path from said position on said boom towards one side of said boat hull and said second restrainer line section being extended in a second path from said position on said boom towards the opposite side of said boat hull, the restrainer line sections extending from the sides of the boat hull and being interconnected and movable as a unit in response to pivotal movement of the boom about the mast;

means for frictionally resisting said pivotal movement of the boom including first and second guide members for said restrainer line, said first and second guide members each having a fixed guide surface engagable with the restrainer line for frictionally resisting movement of the restrainer line; and tension adjusting means interacting with said guide members for adjusting the forces applied against the restrainer line, thereby frictionally resisting movement of the restrainer line along the guide surfaces, thereby resisting movement of the boom.

16. Apparatus according to claim 15, including a pivotal support for said guide members, the friction surfaces facing in generally opposite directions, and wherein said tension adjusting means comprises a pivot for pivoting the guide members from a first position in which the restrainer line moves freely relative to the guide surfaces to positions in which the guide surfaces offer increasing frictional resistance to movement of the restrainer line.

17. Apparatus according to claim 16, further including biasing means for biasing said guide members to said first position in which the restrainer line moves freely relative to the guide surfaces.

18. Apparatus according to claim 17, wherein the tensioning means further includes a releasable control device releasable to allow pivotal movement of said guide members under action of said biasing means to said first position.

* * * * *